US005109619A

United States Patent [19]

Noggle

[11] Patent Number: 5,109,619

[45] Date of Patent: May 5, 1992

[54] PICTURE FRAME RETAINER

[75] Inventor: Michael K. Noggle, Yorba Linda, Calif.

[73] Assignee: Southern Plastic Mold, Inc., Anaheim, Calif.

[21] Appl. No.: 649,366

[22] Filed: Jan. 31, 1991

Related U.S. Application Data

[63] Continuation of Ser. No. 443,271, Nov. 29, 1989, abandoned.

[51] Int. Cl.[5] ..... G09F 1/12

[52] U.S. Cl. ..... 40/152.1; 40/156

[58] Field of Search ..... 40/152, 152.1, 154, 40/156, 159.2, 160, 1.5, 1.6, 27.5, 358, 603, 604, 661, 591; 248/488, 490

[56] References Cited

U.S. PATENT DOCUMENTS

| | | | |
|---|---|---|---|
| 1,867,964 | 7/1932 | Bott | 40/1.5 |
| 2,361,479 | 10/1944 | Joffo | 40/154 |
| 2,736,975 | 3/1956 | Grotthuss | 40/152 |
| 3,407,523 | 10/1968 | Winston | 40/1.5 |
| 3,470,644 | 10/1969 | Craig | 40/159.2 |

*Primary Examiner*—Kenneth J. Dorner
*Assistant Examiner*—J. Bonifanti
*Attorney, Agent, or Firm*—Knobbe, Martens, Olson & Bear

[57] ABSTRACT

A picture frame unit comprised of a main front frame together with a one-piece retainer as a backing for the unit. The edges of the retainer snap into the frame causing a number of integral spring biased pads to press against the back of the picture placed within the unit. The snap-in mechanism secures the retainer into the back of the frame while the retainer pads secure the picture into place within the unit.

27 Claims, 3 Drawing Sheets

PICTURE FRAME RETAINER

This application is a continuation of U.S. Pat. Application Ser. No. 443,271, filed Nov. 29, 1989, now abandoned.

BACKGROUND OF THE INVENTION

This invention relates to a picture frame unit with a one-piece retainer for holding a picture securely in place.

Conventional picture frames usually comprise two or more rectangular main pieces. In use, a picture is placed or slid on or into one of these pieces, usually the front-facing piece. Second, one or more of the remaining pieces are placed on the first piece with the result that the picture is sandwiched within the now-assembled unit. Finally, the unit is secured into place such that, when moved or hung on a surface, the structure remains tightly together and will not allow the picture sandwiched within to move about and thereby become askew or to fall out.

Picture frame securing mechanisms come in a great variety of arrangements. Numerous picture frame units require the placing of strips or pieces of material, such as cardboard or thick paper, posterior to the picture. When the backing of the frame unit is set into place in one arrangement, rotating elements, attached to the main frame piece, are used to clamp the backing into place. This variety of securing mechanism is cumbersome and often ineffectual because of the propensity of the elements to slip out of position.

In another common type of picture frame securing mechanism, the main frame piece is constructed with an inwardly-facing lip in the back. Once the picture and any other filler pieces have been set into place within the main frame piece, objects are placed between the backing and the inside lip of the frame. These objects, which might consist of cardboard strips, spring elements, curved pieces of metal, etc., are trapped between the backing and the lip and similarly trap the backing and picture in place. These types of units are also cumbersome and can be difficult to assemble due to the number of pieces involved Other picture frames employ a back piece which slides into slots located in the back of the main frame. As with most frames, however, this type requires a piece of cardboard or similar material to be placed between the sliding back piece and the picture. This additional layer is necessary to prevent damage to the picture from the sliding back piece and to provide some resiliency for holding the picture securely in place.

Still other methods of securing a picture within a frame are of a more permanent or semi-permanent nature. Some require staples, screws, or nails to secure the pieces of the frame unit together. These methods may damage the frame material and entail a difficult and tedious task of removal and reinsertion if one wishes to change the picture within. Other types of frames, such as those for many prints, have a backing of stiff paper, cardboard, or thin wood attached permanently to the back of the frame. This type of backing is not designed to be removed and any attempt to do so may cause irreparable damage to the frame unit.

A common thread running through the known arrangements is the difficulty of securing a picture within and/or removal of a picture from the frame unit. With many, there are an unnecessary number of pieces which, often, are easy to misplace and which may be needlessly cumbersome to install. In others, the picture is more or less permanently set within the frame unit and insertion and/or removal of the picture is difficult. Therefore, there is a need for a picture frame unit that consists of the fewest feasible number of pieces, that provides for quick and simple insertion and removal of a picture, and that holds the picture securely and safely in place.

SUMMARY OF THE INVENTION

The present picture frame invention consists of a main front frame and a one-piece retainer which snaps into or otherwise attaches to the back of the frame. When the retainer is snapped in, flexibly mounted pads on the retainer are forced toward the back of the picture, thereby holding it in place. In a preferred form, the pads are centrally located on flexible strips of the retainer bordered by elongated openings in the retainer.

The edge of the retainer and the edge of the frame have corresponding male and female aspects which form a snap-in mechanism. This includes bevelled edges which fit into angular grooves. When the retainer is placed into the back of the frame, the bevelled edges snap into their corresponding grooves, thereby securing the retainer and the retainer pads into place.

This arrangement provides a simple, quick, and efficient method of securing a picture within a picture frame. There is only one piece which need be installed into the main front frame of the unit. No extraneous pieces of cardboard, plastic, metal or any other material are necessary.

DETAILED DESCRIPTION OF THE PREFERRED EMBODIMENT

Figure 1:
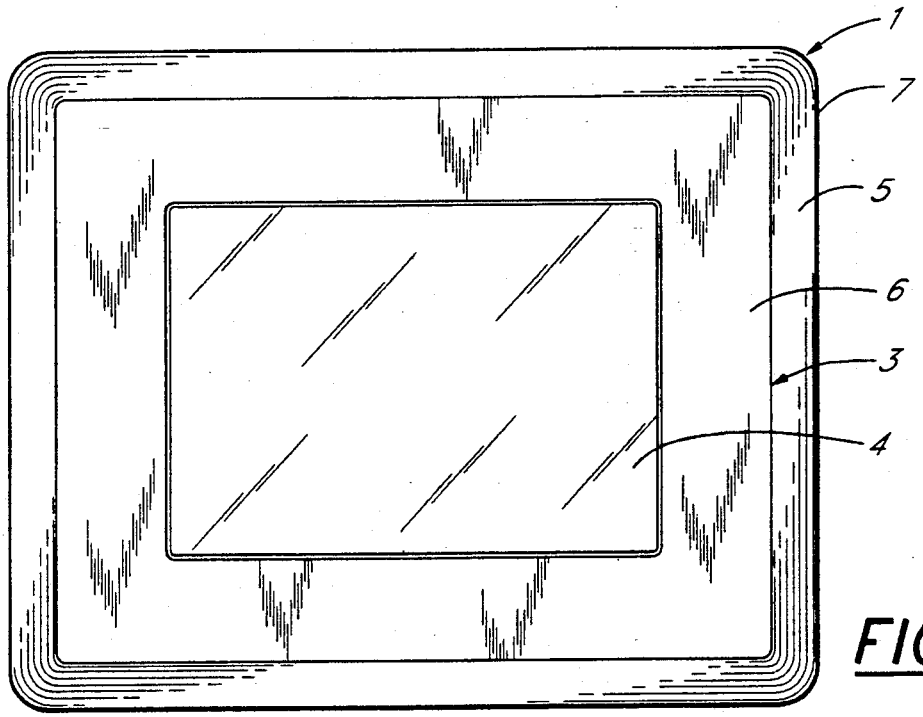
FIG. 1 is a plan view of the front of the frame.
Figure 2:
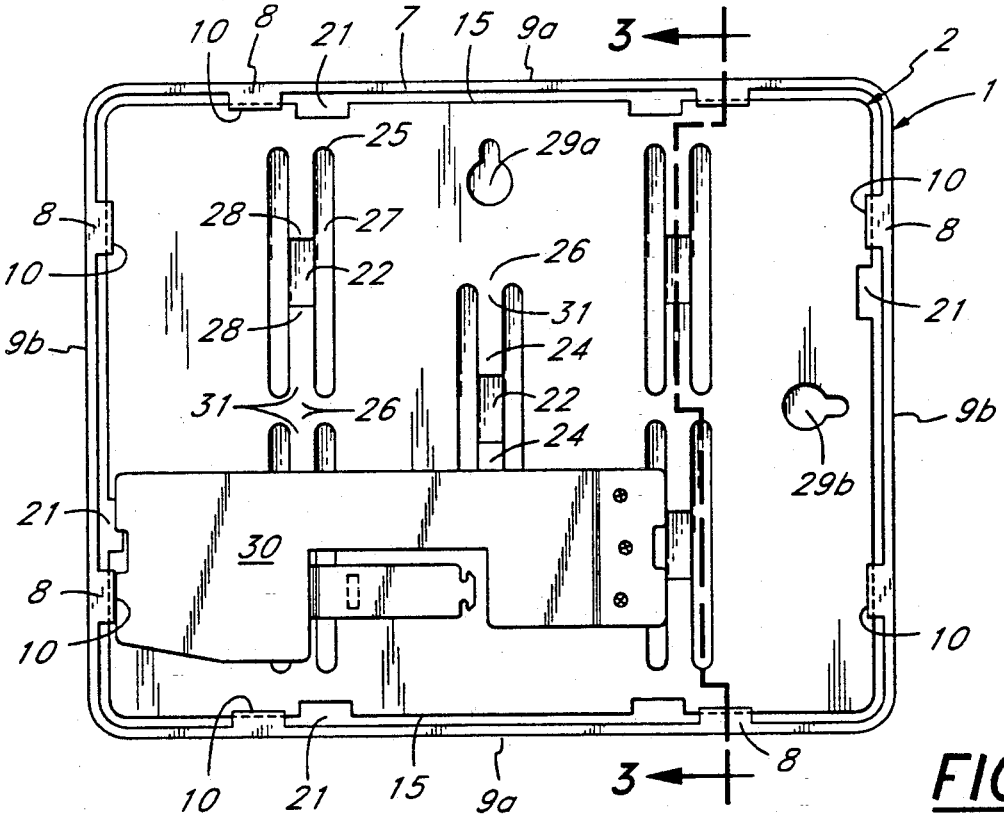
FIG. 2 is a plan view of the back of the frame unit with the in place.
Figure 3:
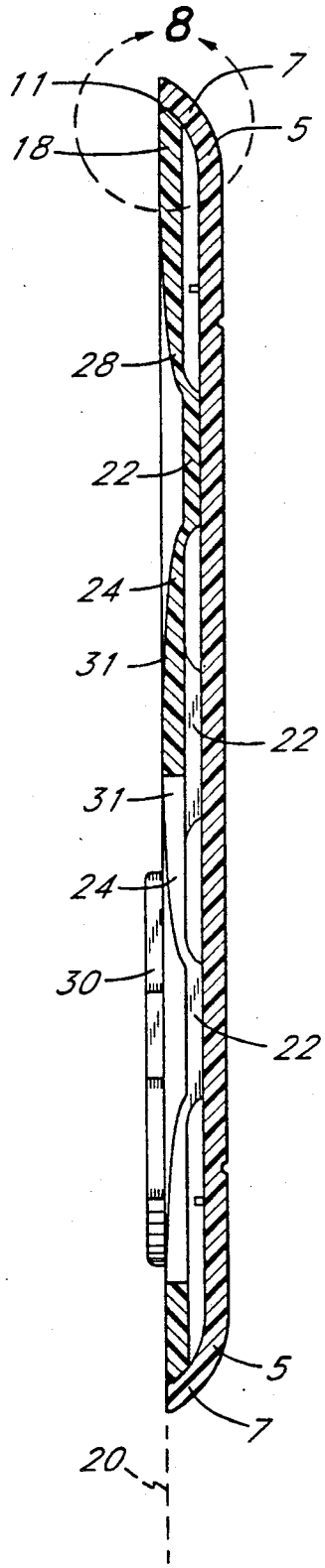
FIG. 3 is a cross-sectional view of the frame unit taken along cutting plane 3—3 on FIG. 2 which passes through tabs, elongated opening, and retainer strip of the frame unit.

Referring to the FIGS. 1-3, a picture frame retainer unit is shown including a main front rectangular frame and a mating retainer 2. In the preferred embodiment, a front panel 3 of the frame 1 includes a transparent section or pane 4 so that a picture placed within the unit may be viewed from the front through this retainer pane 4. Preferably, the transparent pane 4 does not extend fully to the perimeter 5 of the frame 1, but instead is framed by an integral border 6 designed to give the appearance of wood, metal or other material or artistic design.

The perimeter 5 of the frame 1 includes a wall 7 which extends rearwardly from the front of the frame 1. Around the inside of the perimeter wall 7 on the back side of the frame 1 are located, in the preferred embodiment, a total of eight tabs 8 integral with the wall 7. There are two spaced tabs 8 on each of the horizontally illustrated sides 9*a* and vertically illustrated sides 9*b* of the frame Each tab 8 is positioned directly across from an opposing tab 8 on the opposite side of the frame 1 and each tab 8 extends inwardly towards the interior of the unit.

Figure 7:
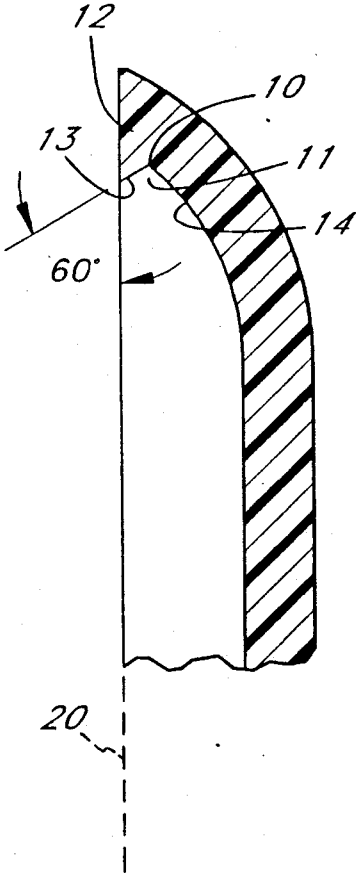
FIG. 7 is an enlarged cross-sectional view of a grooved tab.

In the preferred embodiment, the inside edge 10 of each tab 8 has an inwardly facing groove 11 which forms the female aspect of a snap-in mechanism. Preferably, as best seen in FIG. 7, the cross-section 12 of the groove 11 is angular in shape, with the rear portion 13 angling from rear to front, outward at about sixty degrees from the plane 20 of the frame unit, while the forward portion 14 of the groove 11 angles, from rear to front, inward at about forty-five degrees from the plane 20 of the frame unit. The tabs 8 and grooves 11 form a rectangular opening for receiving the retainer 2.

Figure 8:
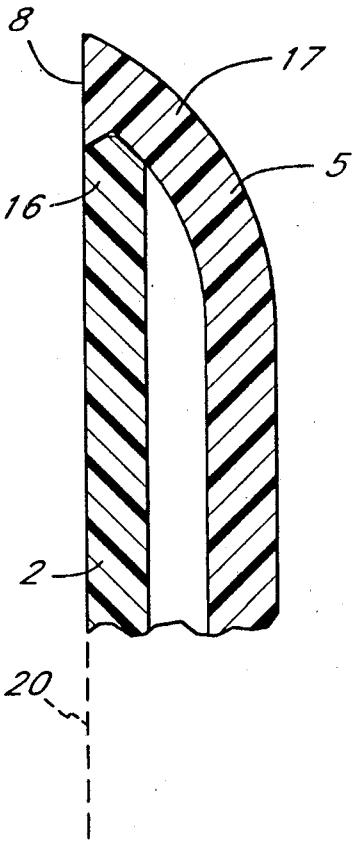
FIG. 8 is an enlarged cross-sectional view of a bevelled retainer edge snapped into place in a grooved tab.
Figure 6:
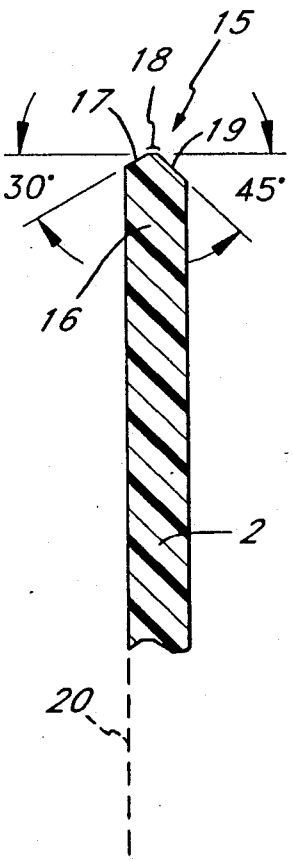
FIG. 6 is an enlarged cross-sectional view of a bevelled retainer edge.

The retainer 2 is a one-piece generally rectangular element dimensioned in both length and width to fit within and snap into the back of the frame. In the preferred embodiment, the outside edge 15 of the retainer 2 comprises the male aspect of the snap-in mechanism. As best seen in FIG. 6, the outside edge 15 is bevelled outward, having a cross-section 16 which is angular in shape that corresponds with and fits into the grooves 11 on the tab 5. Therefore, in preferred embodiment, the rear portion 17 of the bevel 18 angles, from rear to front, outward at about sixty degrees from the plane 20 of the frame unit, while the forward portion 19 of the bevel 18 angles, from rear to front, inward at about forty-five degrees from the plane 20 of the frame unit. The resulting bevelled edge 15 will, when snapped into place, fit into the grooves 11 of the tabs 8 located on the back of the frame 1, as seen in FIG. 8. Both the tabs 8 and the outside perimeter 5 of the frame 1 are preferably constructed of plastic such that, when the retainer 2 is snapped into or out of place, the plastic side wall 7 flexes by bending outward slightly to allow the bevelled edges 15 entry into or exit from the grooved tabs 8.

The above-described bevel 18 circumscribes the outer edge 15 of the retainer 2 and is designed such that, when the retainer 2 is snapped into place in the back of the frame 1, there is a bevelled edge 15 wherever a grooved tab 8 is positioned. The bevelled edge 15 is, however, interrupted in several places. At six locations around the edge 15 of the retainer 2, in the preferred embodiment, are formed slots 21 or notches. The slots 21 are of sufficient dimension such that a screwdriver, knife, or other similarly shaped tool may be placed into the slot 21 and then under the retainer 2. Pushing down upon the tool creates sufficient leverage to snap the bevelled retainer edge 15 out of the grooved tabs 8. Each slot 21 is preferably located near a tab 8 in order to maximize the rearward force exerted upon said adjacent tab 8 during removal of the retainer 2. The retainer 2 is thus freed and this allows for easy removal and/or insertion of a picture into the frame unit.

In accordance with the invention, another part of the retainer 2 includes a group of flexibly mounted retainer pads 22. The pads 22 are preferably spaced symmetrically on the forward facing side of the retainer 2 and, when pressed against the back 23 of a picture placed inside the frame 1, hold the picture firmly and securely in place against the transparent pane 4.

Each pad 22 is part of the retainer 2 and is located on a strip 24 of retainer material with each end 31 integrated with the main body 26 of the retainer 2. The strip 24 is bordered on both sides by a narrow elongated opening 27 in the retainer 2. Each elongated opening 27 extends through the full depth of the retainer material and is rounded at its ends 25. The result is a narrow strip 24 of retainer material suspended or extending across a given span within the retainer 2 itself.

Figure 5:
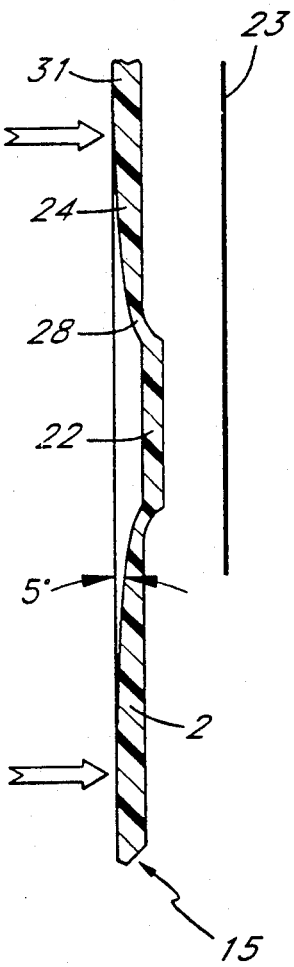
FIG. 5 is an enlarged cross-sectional view of a retainer strip and pad before compression against the back of a picture.

The pad 22 is rectangular in shape, is centered on the strip 24, and has a width equal to the width of the strip 24 on which it is located. The pad 22 is displaced forward on a plane parallel to the plane 20 of the retainer 2, as seen in FIG. 5. The displacement of the pad 22 forward from the plane 20 of the retainer 2 is formed by a forward curvature 28 of the strip 24 material on either side of the pad 22.

Figure 4:
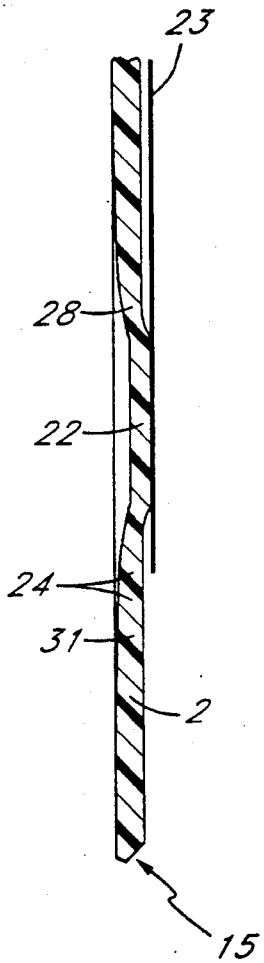
FIG. 4 is an enlarged cross-sectional view of a retainer strip and pad compressed against the back of a picture.

The strip 24 is flexible and resilient because of being elongated and attached only at each of its ends 31. The pad 22 area is the most flexible portion of the strip 24 due to its being furthest from the main body 26 of the retainer 2. Moreover, the thinner curved portion 28 of the strip 24 adjacent the pad 22 adds additional flexibility. As seen in FIG. 5, this portion of the strip 24 narrows in thickness at a five degree angle, on the rear side of the strip 24, from the plane 20 of the retainer 2. In a preferred embodiment, the strip 24 narrows from an initial thickness, at the point of attachment to the main body 26 of the retainer 2, of 0.070 inches to a thickness of 0.034 inches at a point just before the beginning of the forward curvature 28 of the strip 24. When the retainer 2 is snapped into place in the back of the frame 1, the forwardly extending pads 22 are forced against the back 23 of the picture and as a result are displaced rearwardly, as seen in FIGS. 3 and 4. When the pads 22 are thus pressed against the picture, the strips 24 on which they are positioned flex as required and the forwardly acting resilience of the strip 24 provides the pressure necessary to keep the pads 22 firmly pressed against the picture.

The pads 22 are preferably spaced evenly about the retainer 2 in the area in which the picture is placed. In the preferred embodiment, of FIG. 2, four pads 22 are located at each of the four corners of that area, while a fifth 22 pad is located at the center of the area. The combined force of the pads 22 is firm, yet spread out evenly over a large enough surface area so as to not damage any portion of the picture. Moreover, since each strip 24 is connected at both ends 31 to the main body 26 of the retainer 2, the flat pads 22 remain parallel to the front panel 3 in their displaced positions. Therefore, the force applied by each pad 22 is evenly dispersed over the surface area of that pad 22, and the picture is not damaged by excessive pressure applied by any portion of any pad 22.

The retainer 2 preferably has two holes 29*a* and 29*b* for hanging the frame unit on a nail or other similar object projecting from a wall or other surface. One hole 29*a* is centered near the edge of one of the long sides 9*a* of the retainer 2, and is thus used for hanging the frame unit with the long side 9*a* horizontal. The other hole 29*b* is centered near the edge of one of the short sides 9*b* of the retainer 2, and is thus used for hanging the frame unit with the long side 9*a* vertical. Additionally, a pivotal leg 30 is provided for supporting the unit upright on a horizontal surface.

I claim:

1. A picture frame unit for holding a picture securely within the unit, comprising;

a main frame fronted with a transparent pane for viewing a picture within the unit, said frame having a peripheral wall around an edge of said frame; and a retainer fitting into the back of the frame to secure a picture in place, the frame and the retainer having mating grooved and bevelled surfaces which fit and flexibly snap together to fasten the retainer in the back of the frame entirely within said peripheral wall, said grooved surfaces being located on a plurality of tabs on the back of the frame and said corresponding bevelled surfaces being located on the edge of the retainer.

2. The unit of claim 1 wherein said frame is constructed from plastic or other flexible material to allow entry of the bevelled edges into the corresponding grooved tabs.

3. A picture frame unit for holding a picture securely within the unit comprising;

a main frame fronted with a transparent pane for viewing a picture within the unit, said frame having grooved surfaces located on a plurality of tabs on the back of said frame, said grooved tabs comprising a rear surface which angles, from rear to front, outward at about sixty degrees from the plane of the frame unit, and a front surface which angles, from rear to front, inward at about forty-five degrees from the plane of the frame unit; and a retainer fitting into the back of the frame to hold a picture in place, said retainer having bevelled surfaces located on the edge of said retainer, said bevelled edges comprising a rear surface which angles, from rear to front, outward at about sixty degrees from the plane of the frame unit and a front surface which angles, from rear to front, inward at about forty-five degrees from the plane of the frame unit, said bevelled surfaces matingly fitting and flexibly snapping together with said grooved tabs to fasten the retainer in the back of the frame.

4. A picture frame unit for holding a picture securely within the unit comprising;

main frame fronted with a transparent pane for viewing a picture within the unit;

a retainer fitting into the back of the frame to hold a picture in place, the frame and the retainer having mating grooved and bevelled surfaces which fit and snap together to fasten the retainer in the back of the frame; and a number of slots in the retainer edge and cut out of the plane of the retainer for receipt of a screwdriver or similar implement in and underneath the slot for leveraged removal of the retainer.

5. The unit of claim 4 wherein each slot is positioned in close proximity to a snap-fit attachment point to provide increased disengaging force on the retainer edge with respect to said point during removal of the retainer.

6. A picture frame unit for holding a picture securely within the unit comprising:

a main frame fronted with a transparent pane for viewing a picture within the unit;

a retainer fitting into the back, of the frame to hold a picture in place, the frame and the retainer having mating grooved and bevelled surfaces which fit and snap together to fasten the retainer in the back of the frame;

a picture within said unit between said main frame and said retainer and juxtaposed against said transparent pane so that said picture may be viewed through said pane; and one or more integral spring biased pads on said retainer disposed to press forward against said transparent pane so that pressure is also applied against said picture, wherein said picture is disposed between said pads and said pane, to secure said picture in place, said pads being spaced inwardly from a peripheral edge of said retainer.

7. The unit of claim 8, wherein said pads further comprise:

a first pad formed in an upper left quadrant of the retainer;

a second pad formed in an upper right quadrant of the retainer;

a third pad formed in a lower left quadrant of the retainer; and a fourth pad formed in a lower right quadrant of the retainer, wherein each of said pads is spaced from each of the other three pads so that the cumulative pressing force provided against said picture is generally evenly distributed around a relatively large area of the back of the picture.

8. A picture frame unit comprised of a frame and a one-piece retainer with said retainer having one or more pads, each pad being formed on one or more flexible strips, such that when the retainer is engaged into the back of the frame, the pads are urged forward and cause pressure to be applied against a front panel of the frame thereby holding in place a picture between said pads and said front panel, and causing said strips to flex rearward so that said pads are displaced rearward toward the plane of the retainer.

9. The unit of claim 8 wherein said strips are integrally formed with the retainer.

10. The unit of claim 8 wherein each of said pads comprises a flat surface which faces toward the picture within the frame unit and is in a plane parallel to the plane of the picture such that when the pads are urged toward the picture, said flat surfaces flatly press against the back of the picture so as not to damage the picture.

11. A picture frame unit comprising:

a frame;

a thin one-piece generally flat, plate-like retainer having one or more resilient strips formed between elongated openings on either side of said strip with the ends of the strip being integral with the main body of the retainer, each strip further including a pad which is displaced forwardly in a plane parallel to the plane of the retainer; and a plurality of tabs on the back of the frame, said tabs and edges of the retainer having grooved and bevelled surfaces which snap-fit together.

12. A picture frame unit, comprising:

a frame including a front panel having a transparent pane through which a picture may be viewed;

a wall surrounding the panel and extending rearwardly from the panel;

a picture juxtaposed against said transparent pane and within said wall; and a generally flat, plate-like retainer which fits within said wall behind said panel, said wall and said retainer having interengaging edge portions which snap together to removably hold the retainer within the frame, and wherein said retainer has a plurality of spaced, spring-biased pads formed rearwardly of said picture which extend forwardly from the main body of the retainer, said retainer and pads being constructed such that when the retainer is placed within said wall, the pads are depressed rearwardly as a result of interference with the front panel such that the pads provide a flexible pressing force against the panel.

13. A picture frame unit, comprising:

a front pane through which a picture may be viewed;

a picture behind said front pane; and a plate-like retainer fixed in close parallel relation behind said pane, said retainer having a plurality of spaced pads connected to and extending forwardly towards said pane, said pads being flexibly mounted such that when the retainer is fixed in parallel relation to the pane, the pads are displaced rearwardly by interference with the pane such that the pads provide a continuous flexible pressing force against the picture.

14. The unit of claim 13 wherein each of said pads is mounted on flexible element formed integral with the retainer.

15. The unit of claim 14 including gaps around said flexible elements which allow increased flexibility of said pads with respect to said retainer.

16. The unit of claim 13 wherein said pads are mounted on flexible strips which are connected to the retainer.

17. A picture frame unit, comprising:

a front pane through which a picture may be viewed; and a plate-like retainer fixed in close parallel relation to said pane, said retainer having a plurality of spaced pads connected to and extending forwardly towards said pane, said pads being flexibly mounted such that when the retainer is fixed in parallel relation to the pane, the pads are displaced rearwardly by interference with the pane such that the pads provide a flexible pressing force against the pane, and wherein each of said pads is mounted on a flexible element formed integral with the retainer, and wherein said retainer includes pairs of spaced elongated openings each defining a strip of retainer material bordered by said openings, with the ends of each strip being formed integral with the main body of the retainer, and one of said pads being mounted on said strip.

18. The unit of claim 17 wherein said strip is sufficiently flexible to permit the pad thereon to be deflected rearwardly, displaced by said pane.

19. The unit of claim 18 wherein said pad is centrally located on said strip and said pad has a generally flat surface facing towards said pane, with said pad surface being generally parallel to said pane throughout the movement of said pad.

20. The unit of claim 17 wherein said pane has a generally rectangular shape, and said unit includes at least five of said pads and strips, with one pad positioned adjacent each corner of said pane and one positioned in the central portion of said pane.

21. The unit of claim 17 wherein said strip lies in the plane of said retainer, and said pad extends beyond the plane of the retainer towards said pane.

22. The unit of claim 17 wherein the portions of said strip adjacent each side of said pad are thinner than adjacent portions of the strip so as to provide an increased flexibility in movement of said pads.

23. A method of mounting a picture in a frame unit, comprising:

positioning a front side of a picture against a transparent pane;

positioning a plate-like retainer adjacent the backside of said picture; and clamping the retainer to the pane in a manner to cause one or more pads which are flexibly mounted on flexible strips on the retainer to be displaced rearwardly by the pane so as to provide a pressing force against the pane so that said pads also press said picture against the pane.

24. The method of claim 23 including snapping the retainer into a frame surrounding the pane and the retainer in a manner to maintain the retainer within the frame and in a manner to displace said pads to provide said pressing force.

25. A picture frame unit for holding a picture securely within the unit comprising;

a main frame fronted with a transparent pane for viewing a picture within the unit and said frame having two tabs on each side thereof; and a retainer which fits into the back of the frame to secure a picture in place, said tabs and an edge of said retainer having corresponding mating grooved and bevelled surfaces which fit and flexibly snap together to fasten the retainer in the back of the frame entirely within said peripheral wall.

26. A picture frame unit comprised of a frame and a one-piece retainer with said retainer having one or more integral narrow, flexible elements having an end attached to the retainer, wherein each of said flexible elements is bordered by an elongate slot on both sides thereof which define generally parallel side edges which permit said elements to flex away from a pane in said frame, and wherein said elements include one or more generally flat pads formed thereon, said pads being spaced inwardly from an edge of the retainer such that, when the retainer is engaged into the back of the frame, said flexible elements are flexed by interference with the pane and said pads cause pressure to be applied against the back of a picture within the frame unit, thereby holding the picture in place.

27. A picture frame unit for holding a picture securely within the unit, comprising;

a main frame fronted with a transparent pane for viewing a picture within the unit, said frame having a peripheral wall around an edge of said frame; and a retainer fitting into the back of the frame to secure a picture in place, the frame and the retainer having mating grooved and bevelled surfaces which fit and flexibly snap together to fasten the retainer in the back of the frame entirely within said peripheral wall, said mating grooved surfaces and bevelled surfaces being formed on mating tabs and edges on the back of the frame unit.

* * * * *